US007823872B2

(12) United States Patent
Sasaki

(10) Patent No.: US 7,823,872 B2
(45) **Date of Patent: *Nov. 2, 2010**

(54) MEDIUM DELIVERY DEVICE, MEDIUM PROCESSING APPARATUS AND CHECK DELIVERY DEVICE WITH DUAL PRESSING MEMBERS

(75) Inventor: Toshiyuki Sasaki, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 108 days.

This patent is subject to a terminal disclaimer.

(21) Appl. No.: 12/002,578

(22) Filed: Dec. 18, 2007

(65) Prior Publication Data

US 2008/0211163 A1 Sep. 4, 2008

(30) Foreign Application Priority Data

Feb. 19, 2007 (JP) ..... 2007-037451

(51) Int. Cl.
*B65H 1/12* (2006.01)

(52) U.S. Cl. ..... 271/127; 271/126; 271/149; 271/160

(58) Field of Classification Search ..... 271/149, 271/160, 126, 127
See application file for complete search history.

(56) References Cited

U.S. PATENT DOCUMENTS 5,088,718 A * 2/1992 Stepan et al. ..... 271/161
5,715,071 A 2/1998 Takashimizu et al.
6,089,563 A 7/2000 Takashimizu et al.
6,832,723 B2 12/2004 Murata et al.
6,983,885 B2 1/2006 Endo et al.
2005/0035531 A1 2/2005 Sasaki et al.
2005/0129441 A1* 6/2005 Hirabayashi ..... 399/405

FOREIGN PATENT DOCUMENTS

JP 60-67345 4/1985
JP 62-8935 1/1987
JP 6-127705 5/1994

(Continued)

OTHER PUBLICATIONS

European Search Report dated Apr. 6, 2009.

*Primary Examiner*—Gene Crawford
*Assistant Examiner*—Gerald W McClain
(74) *Attorney, Agent, or Firm*—Nutter McClennen & Fish LLP; John J. Penny, Jr.; Rory P. Pheiffer

(57) ABSTRACT

A medium delivery device comprising a medium insertion section into which a sheet-shaped medium to be delivered is inserted in a stacked state, first and second medium guide surfaces that are opposed to each other to guide the sheet-shaped medium to the medium delivery port, a feed roller that is disposed at a side of the first medium guide surface and delivers the sheet-shaped medium inserted into the medium insertion section, to the medium delivery port, a first pressing member that presses the sheet-shaped medium inserted into the medium insertion section against the feed roller, a second pressing member that presses the sheet-shaped medium inserted into the medium insertion section against the first medium guide surface at a position deviating from the feed roller, and a driving mechanism that drives the first pressing member in directions in which the first pressing member moves close to and away from the feed roller.

13 Claims, 9 Drawing Sheets

FOREIGN PATENT DOCUMENTS

| | | |
|---|---|---|
| JP | 7-323935 | 12/1995 |
| JP | 09-058879 | 3/1997 |
| JP | 2003-87497 | 3/2003 |
| JP | 2004-206362 | 7/2004 |
| JP | 2005-35791 | 2/2005 |
| JP | 2005-132570 | 5/2005 |
| JP | 2006-290564 | 10/2006 |
| JP | 2007-022688 | 2/2007 |

* cited by examiner

MEDIUM DELIVERY DEVICE, MEDIUM PROCESSING APPARATUS AND CHECK DELIVERY DEVICE WITH DUAL PRESSING MEMBERS

This application claims priority from Japanese Patent Application No. 2007-037451 filed on Feb. 19, 2007, the entire disclosure of which is expressly incorporated by reference herein.

BACKGROUND

1. Technical Field

The present invention relates to a medium delivery device mounted on a medium processing apparatus such as a check processing apparatus, a printer, a scanner, and a magnetic reading apparatus in order to separate sheet-shaped mediums such as checks and recording papers and to deliver them one by one.

2. Related Art

In financial institutions such as banks, types of checks (types of securities) such as a check and a bill are put into a check processing apparatus, surface images and magnetic ink characters thereon are read out, and then a classification operation of the types of checks is performed on the basis of the reading-out result. Recently, as electronic payments have come into wide use, the read image data and magnetic ink characters have been processed by computers and these kinds of checks have been managed by computers. In Patent Document 1, such a check processing apparatus is disclosed.

In the check processing apparatus, checks are inserted into a check insertion section in a stacked state and the inserted checks are sent to a transport passage by a feed roller disposed in a medium separating mechanism. In order to deliver the checks by the feed roller, the medium separating mechanism is provided with a pressing member so that the checks are pressed against the feed roller.

Generally, a rotation-type member is employed as the pressing member, which is rotated about one end thereof so that the checks are pressed against the feed roller at the other end. The rotation-type pressing member has a simple structure and has a high reliability in operation, in comparison with a parallel-moving pressing member.

Patent Document 1: JP-A-No. 2004-206362

The rotation-type pressing member presses the check at a position in the vicinity of the feed roller, and the rotation-type pressing member is in a state where the check is not restricted in a stacked direction at the other positions than the position in the vicinity of the feed roller. As a result, a check having creases at the front end thereof in a delivery direction may not be delivered, and thus the check may be jammed in the medium separating mechanism.

That is, a width of guide surfaces for guiding the check becomes narrow toward a delivery port thereof. In the vicinity of the delivery port of the medium separating mechanism, the right and left guide surfaces are inclined or bent to approach each other so that the checks are delivered one by one from the delivery port having the small width. When the check stored in the medium separating mechanism in a stacked state has creases or the like at the front end there, the front end of the check is caught at the guide surface portion that is inclined or bent and thus the check may not be delivered. Accordingly, the check may be jammed therein.

When the check in the medium separating mechanism is pressed overall by the use of the parallel-moving pressing member, it is possible to avoid such a problem. However, since the parallel-moving pressing member has a moving mechanism with a complex structure in comparison with the rotation-type pressing member and the number of parts thereof is large, manufacture cost is high and reliability is low.

SUMMARY

An advantage of some aspects of at least one embodiment of the invention is to provide a medium delivery device that is capable of securely delivering the sheet-shaped medium such as a check from the medium insertion section by the use of the rotation-type pressing member, a medium processing apparatus and check delivery device. The advantage can be attained by at least one of the following aspects:

A first aspect of at least one embodiment of the invention provides a medium delivery device comprising: a medium insertion section into which a sheet-shaped medium to be delivered is inserted in a stacked state; a medium delivery port for delivering the sheet-shaped medium inserted into the medium insertion section; first and second medium guide surfaces that are opposed to each other to guide the sheet-shaped medium to the medium delivery port; a feed roller that is disposed at a side of the first medium guide surface and delivers the sheet-shaped medium inserted into the medium insertion section to the medium delivery port; a first pressing member that presses the sheet-shaped medium inserted into the medium insertion section from a side of the second medium guide surface against the feed roller; a second pressing member that presses the sheet-shaped medium inserted into the medium insertion section from the side of the second medium guide surface against the first medium guide surface at a position deviating from the feed roller; a driving mechanism that drives the first pressing member in directions in which the first pressing member moves close to and away from the feed roller; and an interlocking mechanism that interlocks with an operation of the first pressing member to move the second pressing member in directions in which the second pressing member moves close to and away from the first medium guide surface.

In at least one embodiment of the invention, the sheet-shaped medium inserted into the medium insertion section is pressed by the second pressing member, which interlocks with the operation of the first pressing member that presses the sheet-shaped medium against the feed roller. Accordingly, when the press position pressed by the second pressing member is appropriately set, it is possible to press the sheet-shaped medium where the creases or the like exist against the first guide surface in a flatly stretched state. Therefore, it is possible to securely deliver the sheet-shaped medium delivered by the feed roller, from the delivery port.

When the first pressing member retreats in a direction away from the feed roller, the second pressing member retreats in the same direction by the interlocking mechanism. Accordingly, the second pressing member does not disturb the insertion of the sheet-shaped medium to the medium insertion section, and the width of the medium insertion section does not become narrow due to the disposition of the second pressing member. Therefore, it is possible to secure the number of stored sheet-shaped medium.

In this case, a press position where the sheet-shaped medium is pressed by the second pressing member may be located between the feed roller and the medium delivery port. Specifically, the medium insertion section includes a regular-width medium receiving portion for inserting the sheet-shaped medium and a medium guide portion of which the width becomes narrower as it becomes closer to the medium delivery port from a front end of the medium receiving portion. Accordingly, the front end of the medium receiving portion may be set as the press position pressed by the second pressing member.

When the second pressing member is built in the first pressing member, it is unnecessary to secure an installation space for the second pressing member and it is possible to be configured compactly.

The driving mechanism may include a rotation shaft that rotatably supports the first pressing member and a motor that rotates the first pressing member about the rotation shaft to a retreat position where the first pressing member retreats from the medium insertion section and to a protrusion position where the first pressing member protrudes into the medium insertion section.

In this case, the interlocking mechanism may include: a rotation shaft that equips the first pressing member with the second pressing member so that the second pressing member is rotatable in directions in which the second pressing member moves close to and away from the first medium guide surface; a spring member that urges the second pressing member in the direction in which the second pressing member moves close to the first medium guide surface about the rotation shaft; a member engagement section that is formed in the second pressing member; and a fixation engagement section that is formed at a fixed position at the side of the second medium guide surface, wherein while the first pressing member is at the retreat position, the member engagement section engages with the fixation engagement section to keep the second pressing member at a position retreating from the medium insertion section; and while the first pressing member is rotating from the retreat position to the protrusion position, the member engagement section deviates from the fixation engagement section and the second pressing member is rotated by the urging force of the spring member to protrude into the medium insertion section.

Since the interlocking mechanism with such a configuration has a simple structure, the interlocking mechanism has high reliability in operation and does not result in high cost.

When the above-described medium delivery device is mounted on a medium processing apparatus such as a printer, a scanner, and a magnetic reading apparatus, it is possible to create a medium processing apparatus with high reliability and low cost.

In the invention, in addition to the first pressing member for pressing the sheet-shaped medium against the feed roller, the second pressing member for pressing the sheet-shaped medium inserted into the medium insertion section against the first medium guide surface by interlocking with the first pressing member is provided. Accordingly, when the press position pressed by the second pressing member is appropriately set, it is possible to press the sheet-shaped medium where the creases or the like exist against the first medium guide surface in a flatly stretched state. Therefore, it is possible to securely deliver the sheet-shaped medium delivered by the feed roller, from the delivery port. In addition, when the first pressing member retreats, the second pressing member retreats from the medium insertion section by the interlocking mechanism. Accordingly, there is no case where the second pressing member becomes an obstacle when the sheet-shaped medium is inserted into the medium insertion section, and there is no case the width of the medium insertion section becomes narrow. Therefore, it is possible to secure the number of stored sheet-shaped medium.

BRIEF DESCRIPTION OF THE DRAWINGS

The invention will be described with reference to the accompanying drawings, wherein-like numbers reference like elements.

DESCRIPTION OF EXEMPLARY EMBODIMENTS

Hereinafter, an embodiment of a check processing apparatus having a medium delivery device according to the invention will be described with reference to the drawings.

(Overall Configuration)

Figure 1:
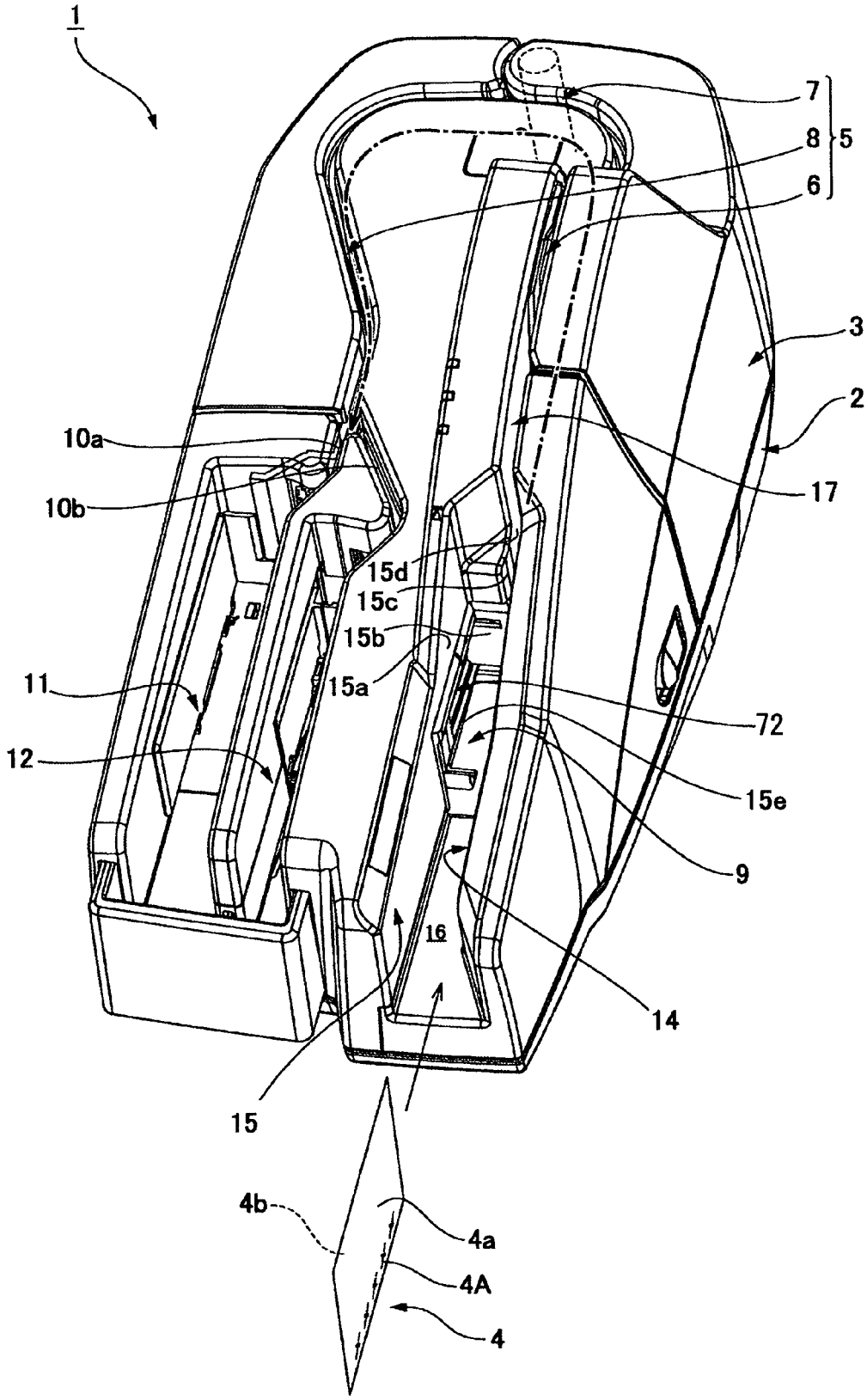
FIG. 1 is a perspective view illustrating an appearance of a check processing apparatus according the invention.
Figure 2:
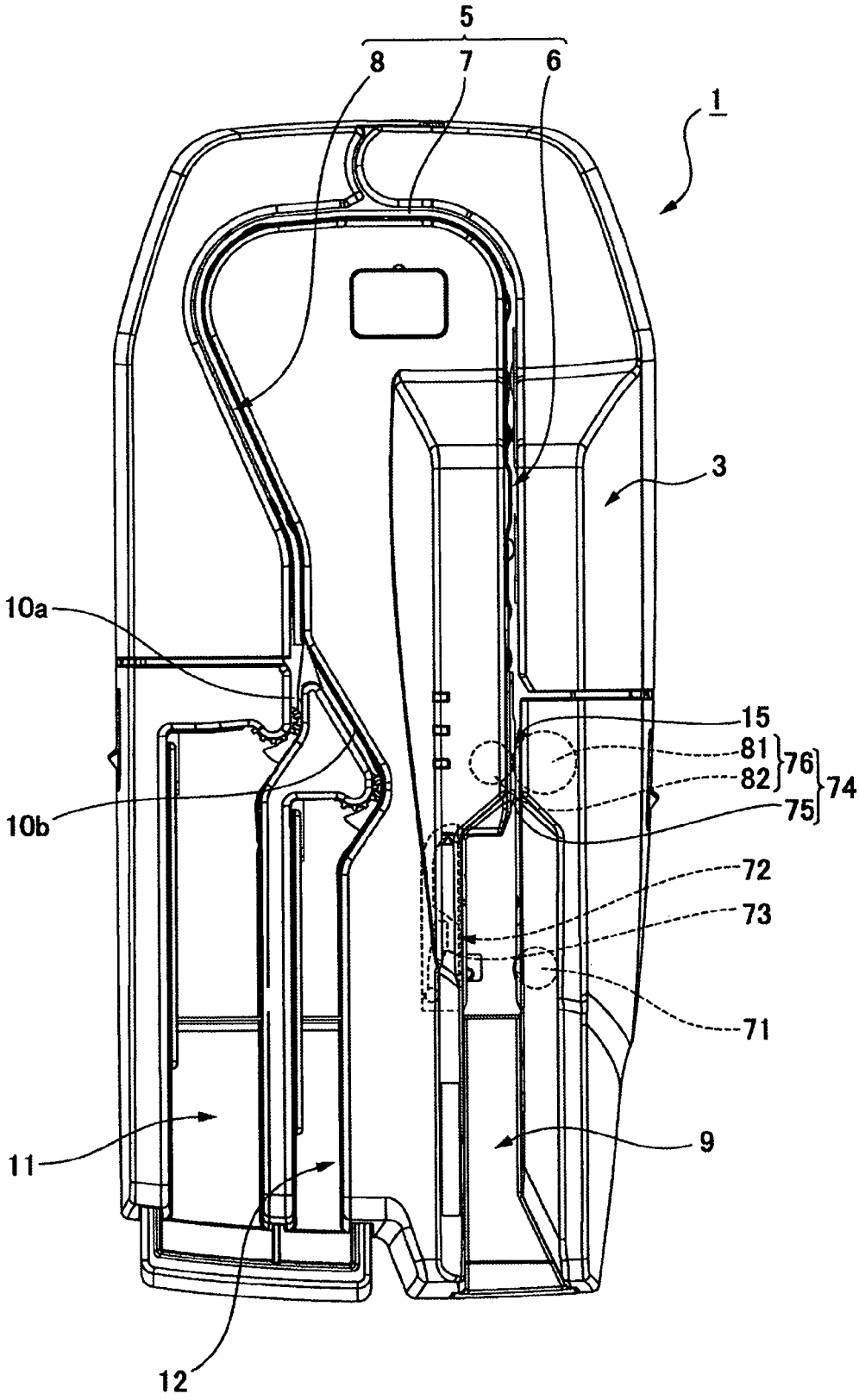
FIG. 2 is a plan view illustrating the check processing apparatus in FIG. 1.

FIG. 1 is a perspective view illustrating an appearance of a check processing apparatus according to the embodiment, and FIG. 2 is a plan view thereof. A check processing apparatus 1 includes a body case 2 and a cover case 3, and various components are built therein. A transport passage 5 of a check 4 (sheet-shaped medium) is formed by a vertical groove with a small width, and the transport passage 5 is formed in the cover case 3. The transport passage 5 has a U shape as viewed from the top and includes a linear upstream transport passage portion 6, a curved transport passage portion 7 extending therefrom, and a slightly curved downstream transport passage 8 extending therefrom.

The upstream end of the upstream transport passage portion 6 communicates with a check insertion section 9 formed of a vertical groove. The downstream end of the downstream transport passage portion 8 is connected to first and second check discharge sections 11 and 12 formed of wide vertical grooves through divergence passages 10*a* and 10*b*, which diverge into right and left sides.

Ink characters 4A are printed on the lower portion of the front surface 4*a* of the check 4 to be read. A sum of money, an issuer, a number, a signature, and the like are described on the front surface 4*a*, and a signature space and the like are provided on the back surface 4*b*.

(Transport Mechanism)

Figure 3:
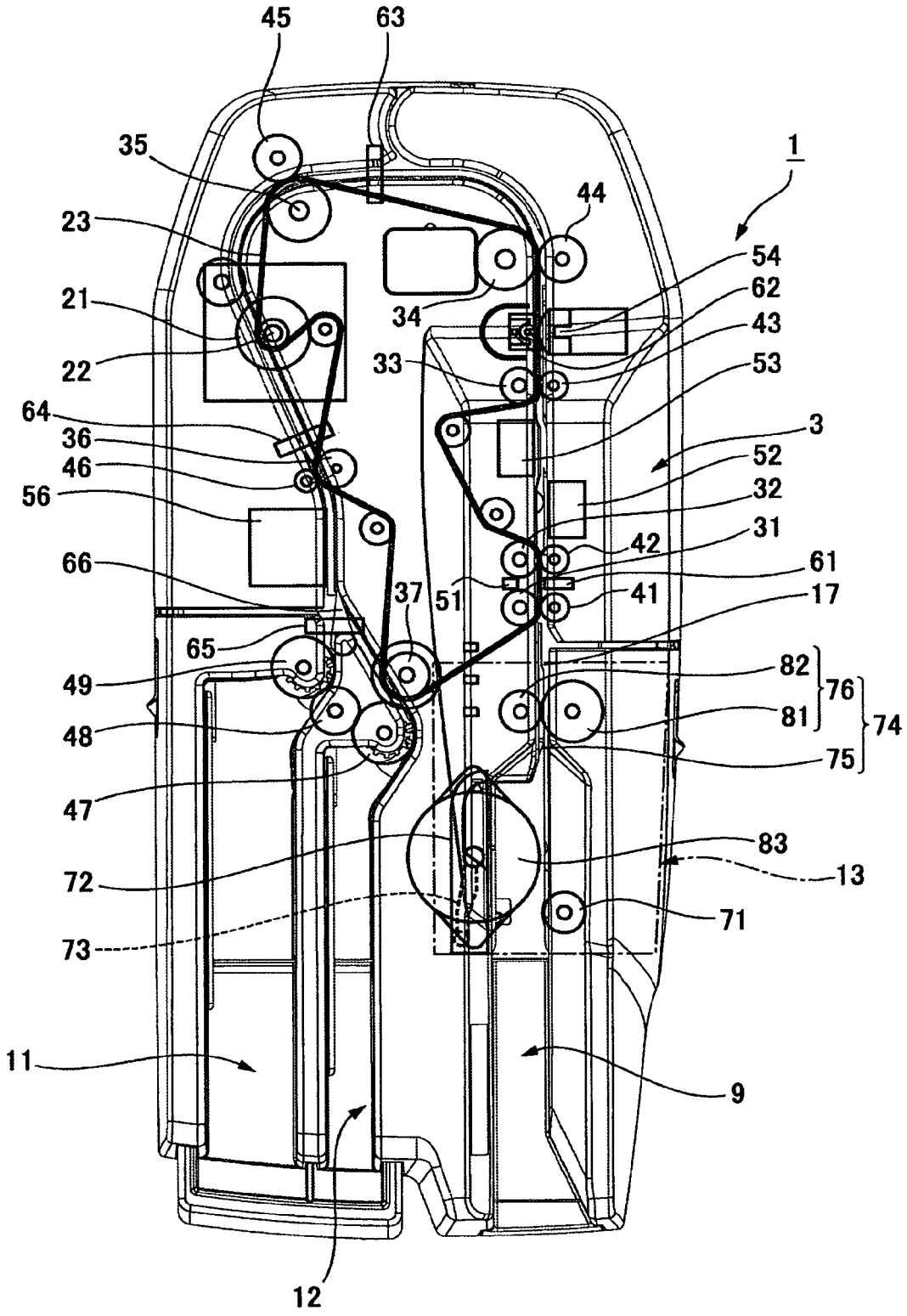
FIG. 3 is a view illustrating a transport mechanism of the check processing apparatus in FIG. 1.

FIG. 3 is a view illustrating a transport mechanism built in the in the center portion of check processing apparatus 1. The check insertion section 9 is provided with a check delivery mechanism 13 for delivering the check 4, which is inserted into the check insertion section 9 in a stacked state, to the transport passage 5. A check delivery device includes the check insertion section 9 and the check delivery mechanism 13. The detailed structure of the check delivery mechanism 13 will be described later.

The transport mechanism that transports the check 4 along the transport passage 5 includes a transport motor 21, a driving pulley 22 installed on the rotation shaft of the transport motor 21, transport rollers 31 to 37 disposed along the transport passage 5, and pressing rollers 41 to 47 that are pressed and rotated by the transport rollers 31 to 37. The rotation of the pressing roller 47 is transferred to a discharge roller 49 through a transfer toothed wheel 48. The transport mechanism further includes an endless belt 23 for transferring the rotation of the transport motor 21 to the transport rollers 31 to 37, which transfers power to the transport rollers 31 to 37.

The transport rollers 31 to 34 are disposed at the upstream end of the upstream transport passage portion 6, the middle thereof, and a boundary position between the upstream transport passage portion 6 and the curved transport passage portion 7, respectively. The transport roller 35 is disposed at a downstream side of the curved transport passage portion 7. The transport roller 36 is disposed at the middle of the downstream transport passage portion 8, and the transport roller 37 is disposed at the vicinity of the discharge port of the second check discharge section 12. The discharge roller 49 is disposed at the vicinity of the discharge port of the second check discharge section 11.

A front-surface contact image scanner 52 serving as front-surface image reading means and a back-surface contact image scanner 53 serving as back-surface contact image reading means are disposed between the transport rollers 32 and 33. A magnetic head 54 for reading out magnetic ink characters is disposed between the transport rollers 33 and 34.

A print mechanism 56 is disposed at the downstream side of the transport roller 36 in the downstream transport passage portion 8. The print mechanism 56 is movable between a printing position pressed against the check 4 and a waiting position retreating from the printing position by a driving motor (not shown). The print mechanism 56 maybe a stamp mechanism that performs a printing operation on the check 4 by pressing it by a plunger.

In addition, various sensors for a check transport control are disposed in the transport passage 5. A paper length detector 61 for detecting a length of the delivered check 4 is disposed between the pressing rollers 41 and 42. An overlapping transport detector 62 for detecting the check 4 transported while overlapping with another check is disposed on an opposite surface of the magnetic head 54. A jam detector 63 is disposed at the front side of the transport roller 35. When the check 4 is continuously detected for a predetermined time by the detector 63, it is possible to recognize a paper jam state where the check 4 is jammed in the transport passage 5. A print detector 64 for detecting the presence of the check 4 to be printed by the print mechanism 56 is disposed at the front side of the transport roller 36. At the divergence passages 10*a* and 10*b* diverged from the transport passage 5 to the first and second check discharge sections 11 and 12, a discharge detector 65 for detecting the check 4 discharged by them is disposed.

A switching plate 66 that is switched by a driving motor (not shown) is disposed at the upstream end of the divergence passages 10*a* and 10*b*. The switching plate 66 selectively switches the downstream end of the transport passage 5 to the first or second check discharge sections 11 and 12, and thus the check 4 is sent to the selected discharge portion.

(Check Delivery Device)

Figure 4:
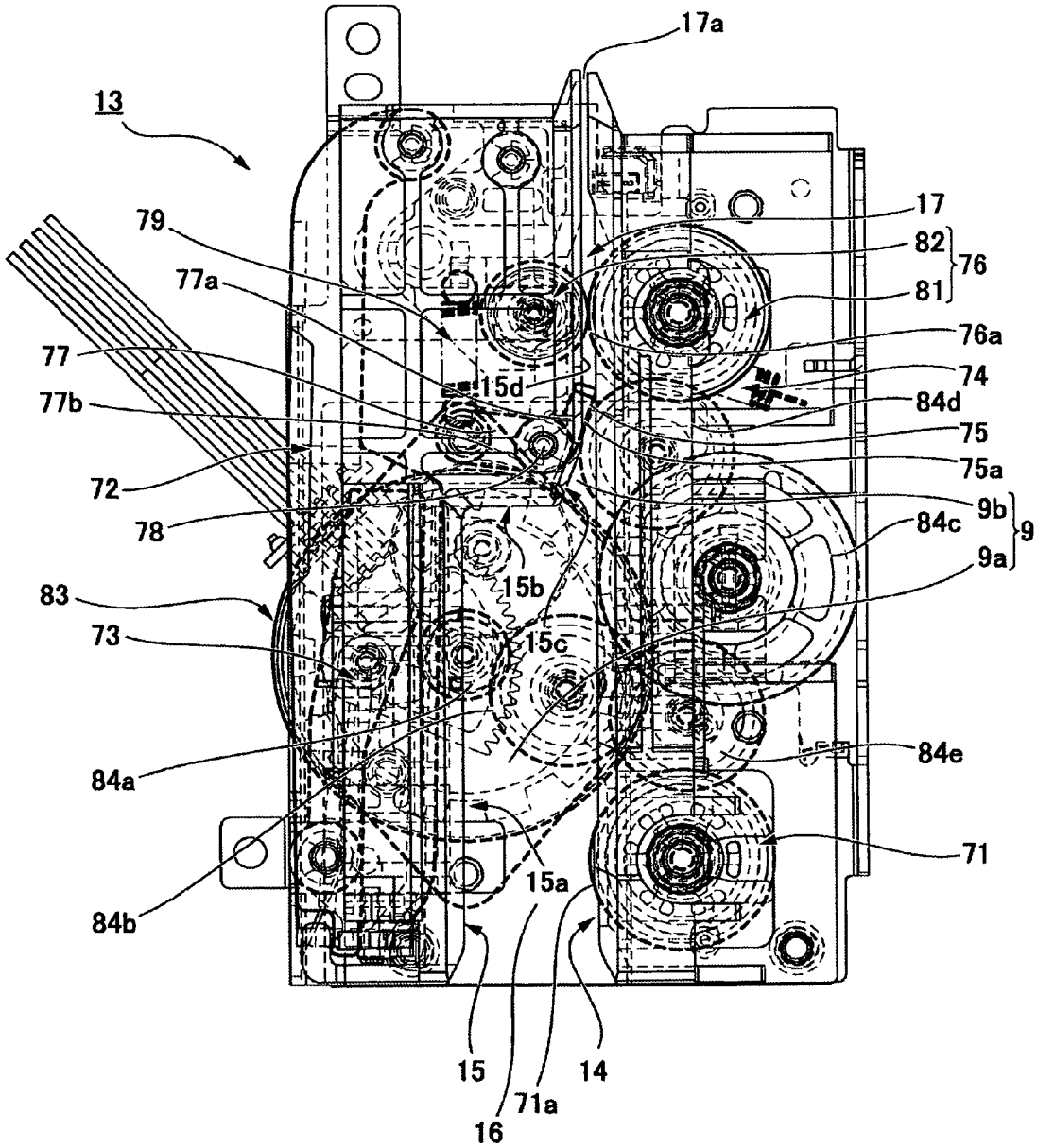
FIG. 4 is a schematic view illustrating a check delivery device of the check processing apparatus.

FIG. 4 is a schematic view illustrating a check delivery device including the check insertion section 9 and the check delivery mechanism 13.

As shown in FIGS. 1 to 4, the check insertion section 9 is basically defined by a first guide surface 14 and second guide surface 15 and a bottom surface 16. The first guide surface 14 is a flat vertical surface. The second guide surface 15 includes a parallel guide surface portion 15*a* disposed substantially parallel to the first guide surface 14 at a predetermined distance, an orthogonal guide surface portion 15*b* bent from the front end of the parallel guide surface portion 15*a* toward the first guide surface 14 at about 90 degrees, an oblique guide surface-portion 15*c* gradually approaches the first guide surface 14 from the end of the orthogonal guide surface portion 15*b*, and a delivery parallel guide surface portion 15*d* that extends from the end thereof and is opposed continuously parallel to the first guide surface at a small distance.

A wide check receiving portion 9*a* (see FIG. 4) for inserting the check 4 is defined by the parallel guide surface portion 15*a* of the second guide surface 15 and the portion of the first guide surface 14 opposed thereto. The front end of the check receiving portion 9*a* has a width smaller than that of the orthogonal guide surface portion 15*b*. At the end of the check receiving portion 9*a*, a check guide portion 9*b* in which an opening width becomes smaller in a check delivery direction is defined by the oblique guide surface portion 15*c* and the portion of the first guide surface 14 opposed thereto. At the end of the check receiving portion 9*b*, a check delivery passage 17 having a substantially constant width is defined by the delivery parallel guide surface portion 15*d* and the portion of the first guide surface 14 opposed to thereto. The end of the check delivery passage 17 is a check delivery port 17*a* (see FIG. 4) connected to the transport passage 5.

As shown in FIG. 4, the check delivery mechanism 13 includes a feed roller 71 for delivering the check 4, a first pressing member 72 for pressing the check 4 against the feed roller 71, and a second pressing member 73 for pressing the check 4 against the first guide surface 14 by interlinking with the first pressing member 72. The check delivery mechanism 13 further includes a separation mechanism 74 for delivering the check 4 one by one, which is delivered to the check delivery passage 17 by the feed roller 71, to the transport passage 5.

The feed roller 71 is disposed substantially in the middle in the check delivery direction of the first guide surface 14, and an outer peripheral surface 71*a* of the feed roller 71 (see FIG. 4) slightly protrudes from the first guide surface 14 toward the check insertion section 9. An opening portion 15*e* (see FIG. 1) is formed in the parallel guide surface portion 15*a* of the second guide surface 15 opposed to the feed roller 71. The first pressing member 72 is movable forward or backward through the opening portion 15*e*. The second pressing member 73 is built in the first pressing member 72.

At the time of delivering the check 4, the first pressing member 72 presses the check 4 in the check insertion section 9 against the feed roller 71, and the second pressing member 73 presses the front end in the delivery direction of the check 4 against the first guide surface 14 at the side of the feed roller 71. When the feed roller 71 is rotated in this state, the check 4 coming into contact with the feed roller 71 is delivered to the check delivery passage 17 and then is supplied to the transport passage 5 through the check delivery passage 17.

The separation mechanism 74 includes a separation pad 75 disposed on the upstream side of the check delivery passage 17 and a pair of separation rollers 76 disposed on the downstream side of the check delivery passage 17. The separation pad 75 is freely rotatable about a vertical rotation shaft 78 installed in a body. A tensile coil spring 79 is suspended between an arm portion 77*b* on the rear side of the separation pad 75 and a portion of the body. The separation pad 75 is continuously urged in a rotation direction in which the arm portion 77*a* on the front side thereof is advanced into the check delivery passage 17, by the force of the tensile coil spring 79. The front end of the separation pad 75 is continuously pressed against the first guide surface 14 in the check delivery passage 17 to keep the check delivery passage 17 blocked.

In the state where the separation pad 75 is pressed against the first guide surface 14, the separation surface 75*a* thereof forms an inclination angle less than 90 degrees about the check delivery direction. In the other words, the front end of the check 4 delivered to the check delivery passage 17 by the feed roller 71 is disposed to collide against the separation surface 75*a* in an angular range of less than 90 degrees. For example, the separation pad 75 is disposed to collide against the separation surface 75*a* at the angle of 20 to 45 degrees. The separation pad 75*a* of the separation pad 75 is formed of materials having a frictional force against the check 4 larger than that between the checks 4. An urging force against the separation pad 75 of the tensile coil spring 79 is set so that the check 4 delivered by the feed roller 71 passes through the separation surface 75*a* while pushing the separation surface 75*a* of the separation pad 75.

The pair of separation rollers 76 disposed on the downstream side of the separation pad 75 include a separation roller 81 disposed on the first guide surface 14 side and a retard roller 82 disposed on the other side. A nip portion 76*a* between the separation roller 81 and the retard roller 82 is set to be positioned at the center in the width direction of the check delivery passage 17, and the retard roller 82 is pressed against the outer peripheral surface of the separation roller 81 with a predetermined pressure. A rotation torque load is applied to the retard roller 82 in the check transport direction by a torque limiter (not shown).

The separation roller 81 is rotated by a driving roller 83. As shown in FIG. 4, the rotation of the driving roller 83 is transferred from a driving toothed wheel 84*a* through toothed wheels 84*b* and 84*c* and a transfer toothed wheel 84*d* to the separation roller 81. In addition, the driving roller 83 serves as a driving source of the feed roller 71. The rotation of the driving roller 83 is transferred from the driving toothed wheel 84*a* and the toothed wheels 84*b* and 84*c* through a transfer toothed wheel 84*e* to the feed roller 71.

Figure 5B:
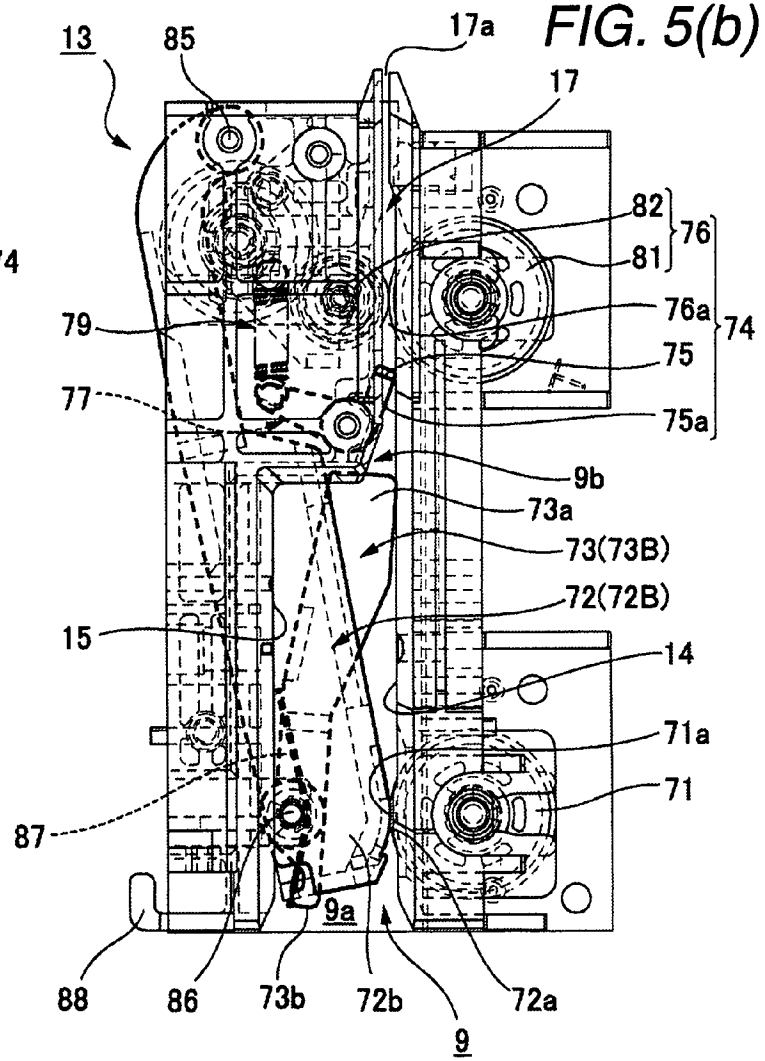
FIGS. 5(*a*) and 5(*b*) are views illustrating an operation of a check transport mechanism.
Figure 5A:
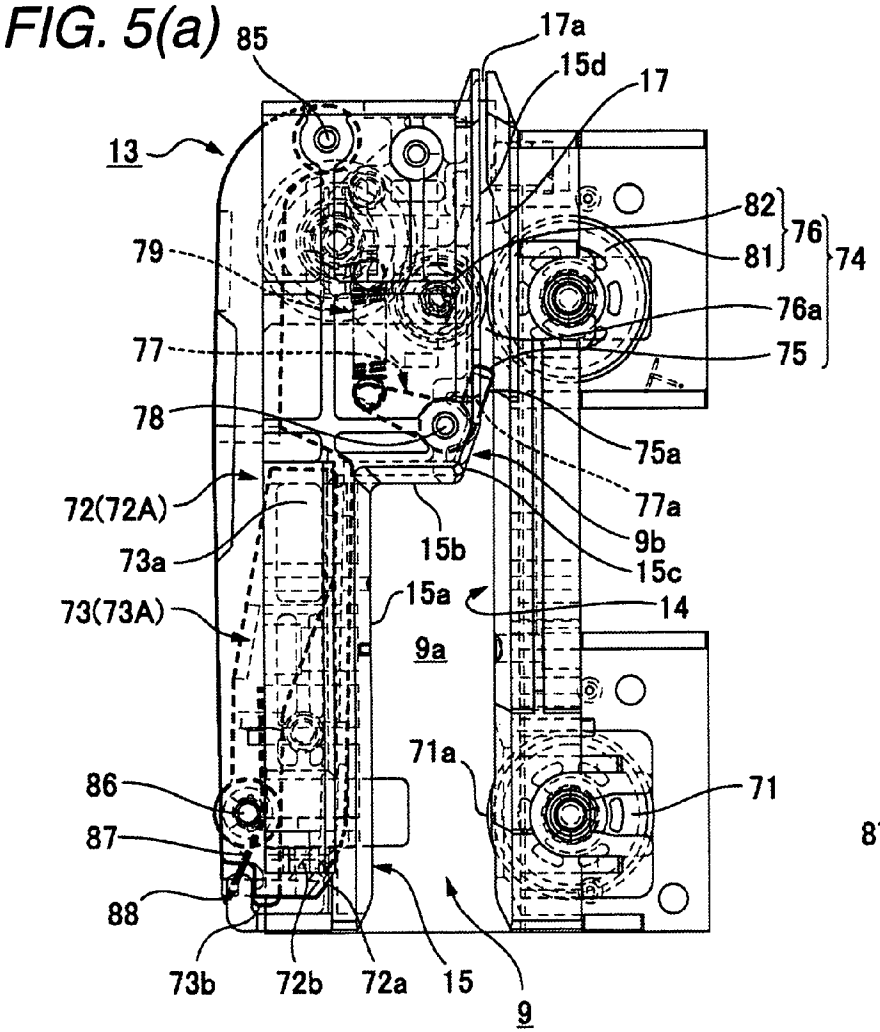

FIG. 5(*a*) is a view illustrating a state where the first and second pressing members 72 and 73 are in a retreat position, and FIG. 5(*b*) is a view illustrating a state where the first and second pressing members 72 and 73 are rotated to a protrusion position. Referring to the drawings, the first pressing member 72 is rotatable in a horizontal direction about a vertical rotation shaft 85 installed in the body, and the first pressing member 72 is rotatable between a retreat position 72A retreating from the parallel guide surface portion 15*a* of the second guide surface 15 shown in FIG. 5(*a*) and a protrusion position 72B where the first pressing member 72 protrudes into the check receiving portion 9*a* of the check insertion section 9 shown in FIG. 5 (*b*) to press the check 4 against the outer peripheral surface 71*a* of the feed roller 71.

The second pressing member 73 is rotatable in a horizontal direction about a vertical rotation shaft 86 installed in the front end portion 72*b* of the first pressing member 72, and the second pressing member 73 is rotatable between a retreat position 73A drawn into the first pressing member 72 shown in FIG. 5(*a*) and a protrusion position 73B where the front end portion 73*a* protrudes from the first pressing member 72 to press the check 4 against the first guide surface 14, as shown in FIG. 5(*b*).

The first pressing member 72 is rotated by a driving motor (not shown). When the driving motor is a step motor, it is possible to control the rotation position of the first pressing member 72 on the basis of the number of steps.

The retreat position 72A of the first pressing member 72, for example, is detected by a sensor (not shown) such as a mechanical switch installed in the body. The operation that presses the first pressing member 72 against the check 4 inserted into the check insertion section 9 is performed, for example, when the check 4 is detected by a transmission-type optical sensor (not shown) installed in the check insertion section 9. When the check 4 is detected, the driving motor 83 is preferable driven on the basis of an instruction from a computer system 103 (see FIG. 8) that is part of the check processing apparatus 1, or on the basis of an instruction inputted in a manual manner; the first pressing member 72 is rotated from the retreat position 72A toward the feed roller 71; and then the check 4 is pressed against the feed roller 71.

Meanwhile, the second pressing member 73 is rotated to the retreat position 73A or the protrusion position 73B while interlinking with the rotation operation of the first pressing member 72. The second pressing member 73 is continuously urged to be rotated in a protrusion direction by a torsion coil spring 87 installed on the vertical rotation shaft 86. A member engagement protrusion 73*b* protruding rearward is formed at the rear of the rotation center of the second pressing member 73, and a fixation engagement protrusion 88 is formed in the body. As shown in FIG. 5(*a*), in the state of the retreat position of the first pressing member 72, the member engagement protrusion 73*b* is pressed against the fixation engagement protrusion 88 by the force of the torsion coil spring 87. Accordingly, the rotation of the second pressing member 73 is restricted, and the second pressing member 73 is kept in the retreat position 73A defined by the fixation engagement protrusion 88.

When the first pressing member 72 is rotated to the feed roller 71, the second pressing member 73 built in the first pressing member 72 also moves. As a result, the member engagement protrusion 73*b* of the second pressing member 73 is separated from the fixation engagement protrusion 88 in the course of the rotation. Accordingly, the second pressing member 73 is released from the rotation driving state. Thus, as shown in FIG. 5(*b*), the front end portion 73*a* of the second pressing member 73 protrudes from the first pressing member 72 about the vertical rotation shaft 86 and is pressed against the first guide surface 14, by the force of the torsion coil spring 87.

In this case, a distance between the feed roller 71 and the separation roller 81 is smaller than a length in the delivery direction of the check 4 to be processed. Accordingly, while the check 4 is fed by the feed roller 71, the front end of the check 4 is delivered to the transport passage 5 through the nip portion 76*a* between the separation roller 81 and the retard roller 82. That is, the transport operation using the feed roller 71 and the separation transport operation using the pair of separation rollers 76 are simultaneously performed on the check 4.

(Check Delivery Operation)

Next, a check delivery operation using the check delivery mechanism 13 will be described with reference to FIG. 6.

When the check 4 is inserted into the check insertion section 9 in a stacked state, the insertion of the check 4 is detected by a sensor (not shown). When the driving motor 83 is driven on the basis of an instruction from a computer system or an instruction inputted in a manual manner, the first pressing member 72 is rotated into the check insertion section 9 to press the check 4 against the feed roller 71.

Figure 6:
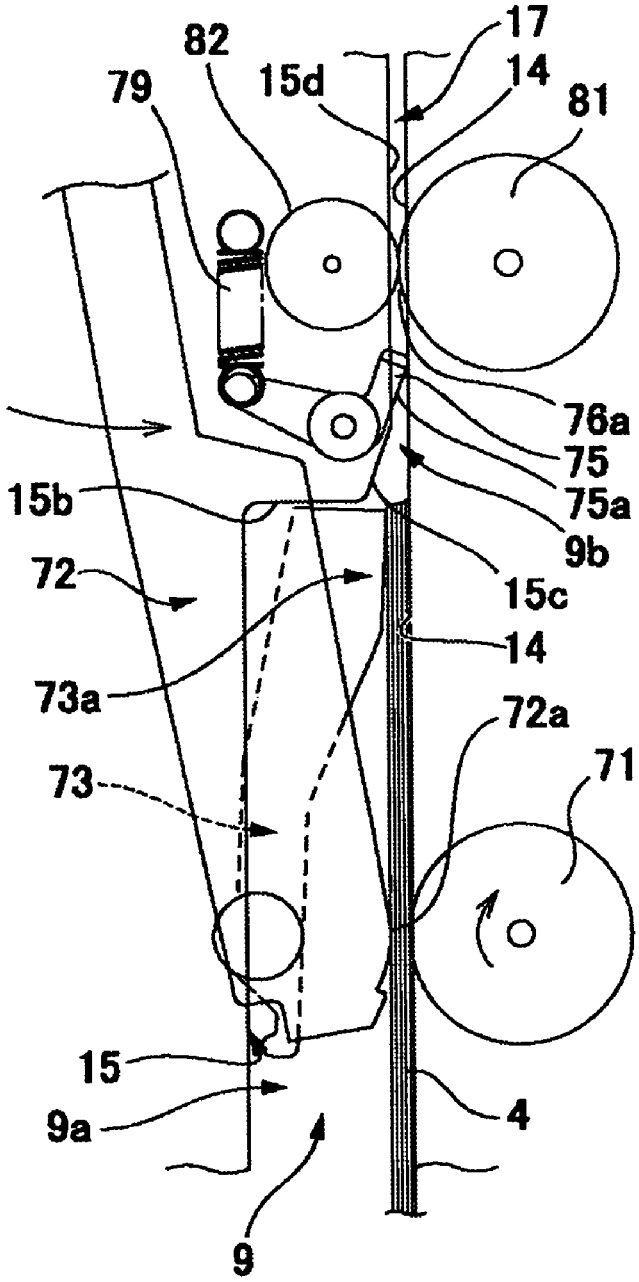
FIG. 6 is a view illustrating an effect of the check transport mechanism.

Subsequently, as shown in FIG. 6, the check 4 inserted into the check insertion section 9 in a bundle is pressed against the feed roller 71 by the front end surface 72*a* of the first pressing member 72 substantially in the middle of the check 4. In addition, the check 4 is in the state where the front end in the delivery direction thereof is pressed against the first guide surface 14 by the front end portion 73*a* of the second pressing member 73.

The front end of the check 4 is pressed against the first guide surface 14 by the second pressing member 73. Accordingly, even when the creases or the like exist at the front end of the check 4, the front end of the check 4 is pressed against the first guide surface 14 and thus the front end of the check 4 does not come into contact with the orthogonal guide surface portion 15*b* of the second guide surface 15 or the like. Therefore, the check 4 is securely delivered to the delivery passage 17 by the feed roller 71.

Figure 7:
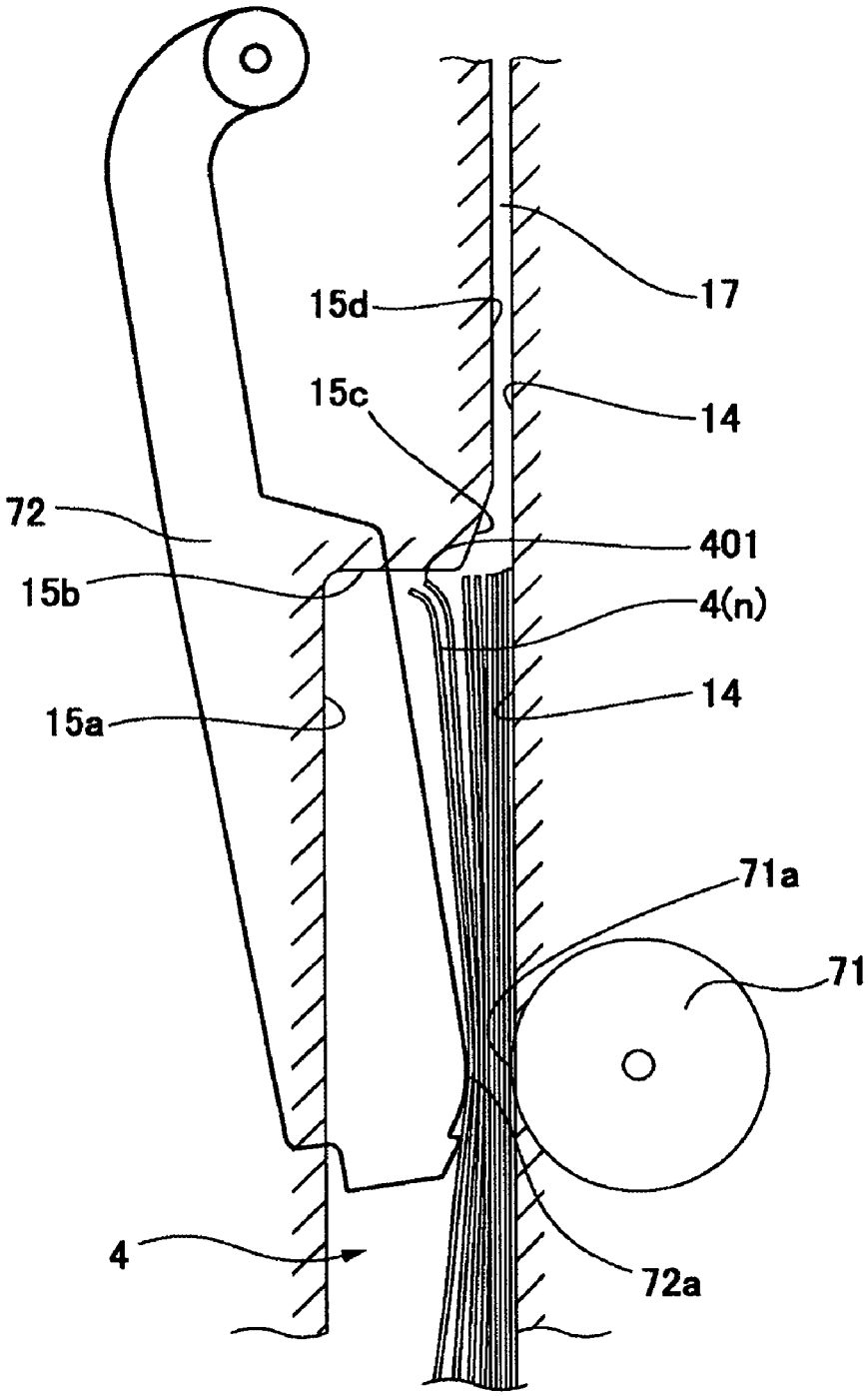
FIG. 7 is a view illustrating problems in the known art.

As shown in FIG. 7, when the check 4 is pressed against the feed roller 71 only by the first pressing member 72 in the same manner as the known art, a triangular gap occurs between the check pressing position of the pressing member 72 and the orthogonal guide surface portion 15*b*. For this reason, the front end 401 of the check 4(*n*) where the creases exist comes into contact with the orthogonal guide surface portion 15*b*. When the check 4(*n*) is delivered by the feed roller 71 in this state, the front end 401 having the creases is not delivered to the check delivery passage 17 and comes into contact with the orthogonal guide surface portion 15*b*, thereby becoming in a block state. In the embodiment, such a triangular gap is removed by the second pressing member 73. Accordingly, it is possible to surely prevent the check 4 from being caught in the check insertion section 9 not to be delivered.

(Effect of Check Delivery Mechanism)

As described above, in the check delivery mechanism 13 according to the embodiment, the front end of the check 4 is pressed against the first guide surface 14 by the second pressing member 73. Accordingly, even when the creases exist at the front end of the check 4, the front end of the check 4 is pressed against the first guide surface 14 and thus the front end of the check 4 does not come into contact with the orthogonal guide surface portion 15*b* of the second guide surface 15 or the like. Therefore, the check 4 is securely delivered to the check delivery passage 17 by the feed roller 71.

Since the second pressing member 73 is built in the first pressing member 72, a space to install the second pressing member 73 is unnecessary. The interlocking mechanism that interlocks with the first pressing member 72 to rotate the second pressing member 73 has the simple configuration including the torsion coil spring 87, the member engagement protrusion 73*b*, and the fixation engagement protrusion 88. Therefore, it is possible for the check delivery mechanism to securely deliver the check 4 by the use of the rotatable pressing members 72 and 73 without increase in size, complexity, or cost of the mechanism.

The above-mentioned description is an example using the invention as the check delivery device of the check processing apparatus. The medium delivery device according to the invention is also applicable to an apparatus for processing a sheet-shaped medium in addition to the check processing apparatus such as a printer, a scanner, and a magnetic reading apparatus in the same manner.

(Control System)

Figure 8:
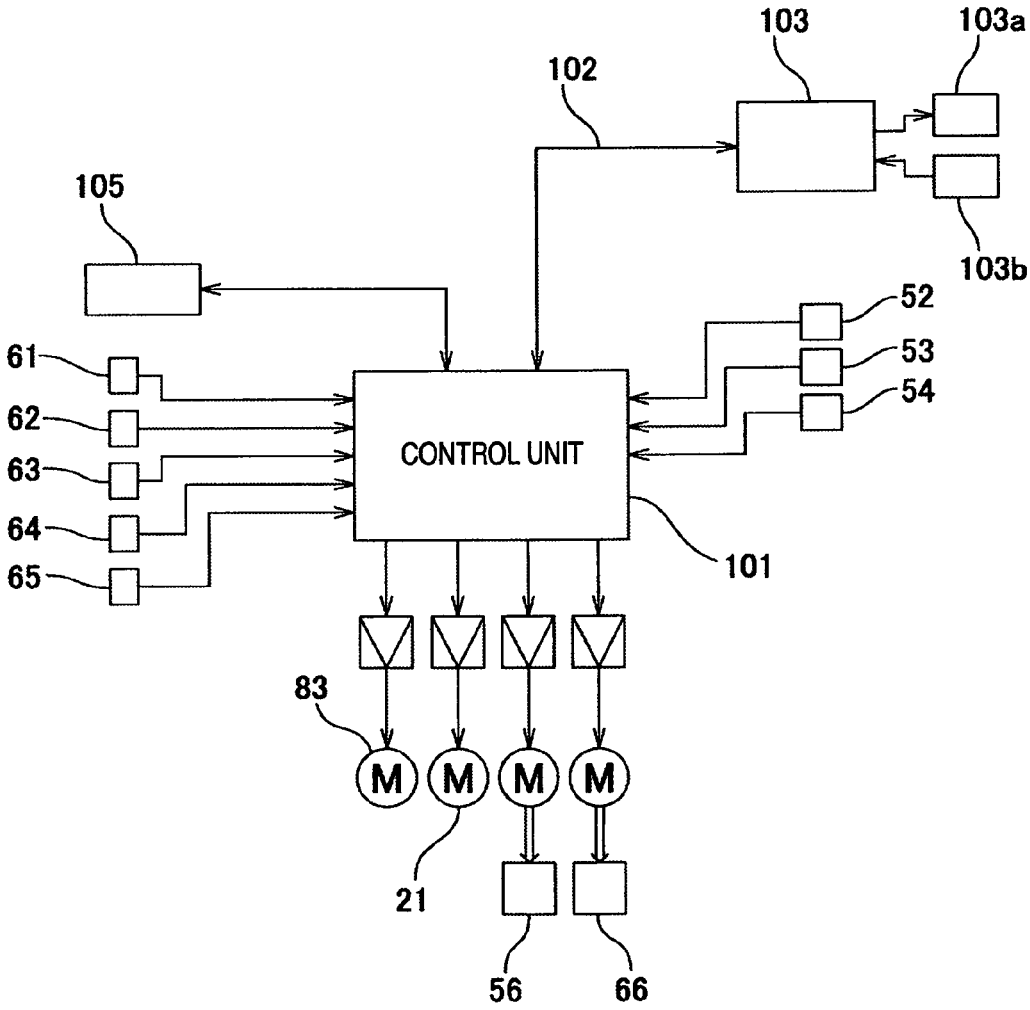
FIG. 8 is a schematic block diagram illustrating a control system of the check processing apparatus.

FIG. 8 is a schematic block diagram illustrating a control system of the check processing apparatus 1. The control system of the check processing apparatus 1 includes a ROM, a RAM, and a control unit 101 formed mainly of a CPU. The control unit 101 is connected to a computer system 103 through a communication cable 102. The computer system 103 includes a display 103*a* and a manipulation unit 103*b* as an input/output device such as a keyboard and a mouse. A start instruction of a check reading operation is inputted from the computer system 103 to the control unit 101.

When the control unit 101 receives the start instruction of the reading operation, the control unit 101 drives the driving motor 83 and the transport motor 21 to delivery the check 4 to the transport passage 5 one sheet by one sheet and to transport the delivered check 4 along the transport passage 5. Front-surface image information, back-surface image information, and magnetic ink character information of the check 4 read by the front-surface contact image scanner 52, the back-surface image scanner 53, and the magnetic head 54 are inputted to the control unit 101, respectively. The information is inputted to the computer system 103, and an image process and a character recognizing process are performed on the information. Then it is judged whether the reading is normally performed or not, and the result of the judgment is inputted to the control unit 101. The control unit 101 controls the print mechanism 56 and the switching plate 66 on the basis of the result of the judgment.

The control unit 101 controls the check 4 to be transported on the basis of the signals detected by the paper length detector 61, the overlapping transport detector 62, the jam detector 63, and the print detector 64, and the discharge detector 65 that are disposed on the transport passage 5. The control unit 101 is connected to a manipulation unit 105 including a manipulation switch such as a power switch formed in the body case 2.

(Check Processing Operation)

Figure 9:
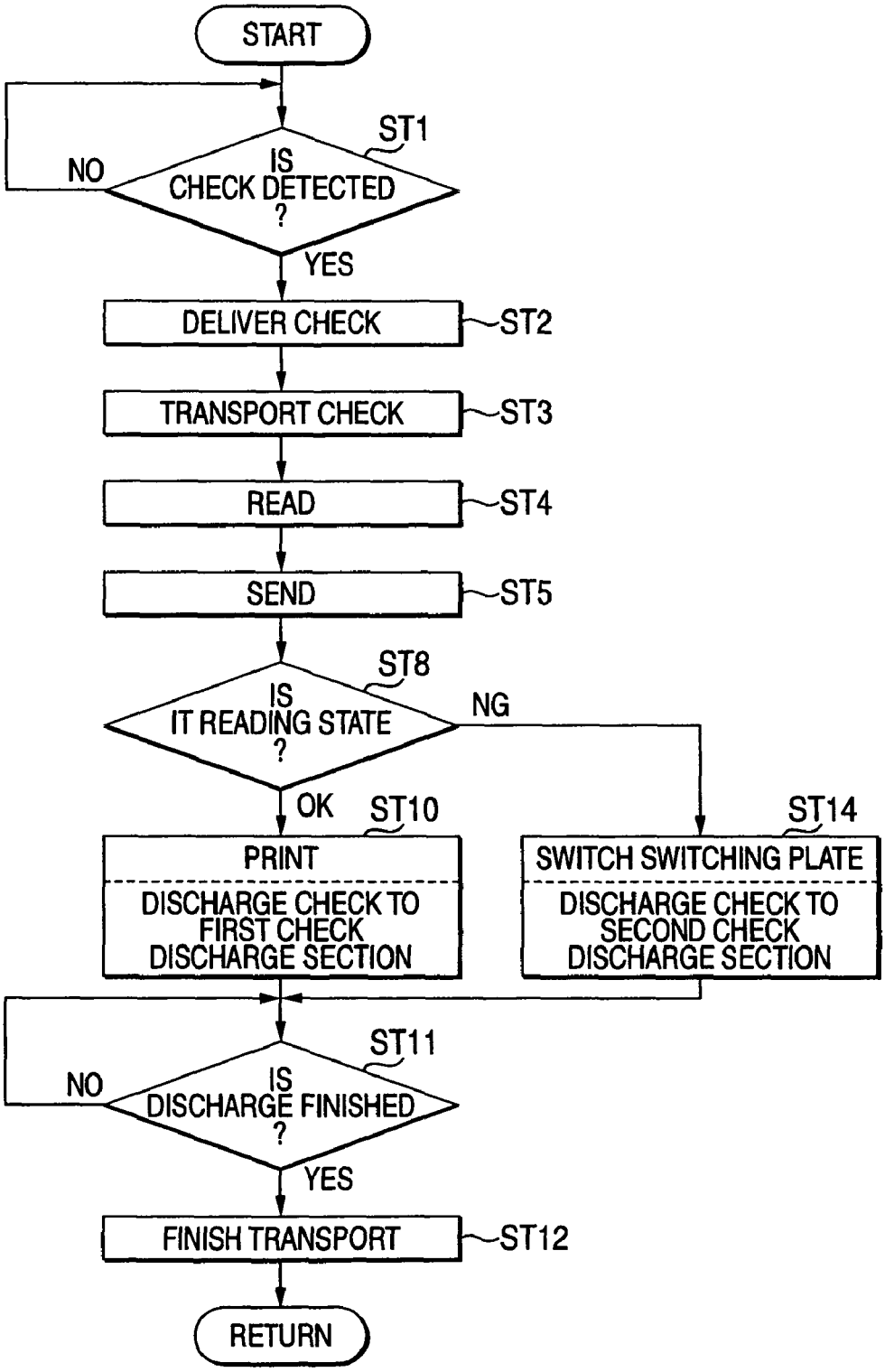
FIG. 9 is a schematic flowchart illustrating a check processing operation of the check processing apparatus.

FIG. 9 is a schematic flowchart illustrating a processing operation of the check processing apparatus 1. First, when a user inputs the start instruction through the manipulation unit 103*b* of the computer system 103, the sensor detects the insertion of the check 4. Then, the feed roller 71 is rotated by the driving motor 83, the pressing member 72 moves, and thus the check 4 is pressed against the feed roller 71. As a result, the check 4 is delivered by the feed roller 71. In addition, the transport roller 21 is driven to rotate the transport rollers 31 to 37. The check 4 fed to the delivery passage 17 is separated into each one sheet by the separation mechanism 74 disposed on the delivery passage 17, and the separated check 4 is delivered to the transport passage 5 (Steps ST1 and ST2).

The delivered check 4 is transported along the transport passage 5 while the delivered check 4 is sequentially guided to the transport rollers 31 to 36 (Step ST3). While the check 4 is transported, the front-surface image, the back-surface image, and the magnetic ink characters are read by the front-surface contact image scanner 52, the back-surface contact image scanner 53, and the magnetic head 54, respectively (Step ST4).

The read information is sent the computer system 103 through the communication cable 102 (Step ST5). The computer system 103 processes the read information about the front-surface image, the back-surface image, and the magnetic ink character, and then the computer system 103 judges whether the reading is normally performed or not. When the check 4 is transported in an up-down reverse state, it is impossible to recognize the magnetic ink characters. Accordingly, this case is judged as a reading failure. When the check 4 is transported in a front-back reverse state, it is impossible to obtain the magnetic ink character information. Accordingly, this case is judged as a reading impossibility. When it is impossible to read a part of the magnetic ink characters because the check 4 is folded, the check 4 is scattered into pieces, or the check 4 is skewed at the time of transport, it is judged also as the reading failure. In addition, when it is impossible to recognize predetermined information such as information about sum of money because the check 4 is folded, the check 4 is scattered into pieces, or the check 4 is skewed at the time of transport, it is judged also as the reading failure.

When it is judged as a normal reading, the print mechanism 56 is moved to the printing position (Steps ST8 and ST10). The check 4 is transported while information such as "electronic payment completion" is printed on the check 4 by the printing mechanism 56, and then the transported check 4 is discharged to the first check discharge-section 11 by the switching plate 66 (Step ST10). After the discharge detector 65 detects the rear end of the check 4, the transport operation is stopped (Steps ST11 and ST12).

When it is judged as a reading failure or a reading impossibility (Step ST8), the switching operation of the switching plate 66 is performed (Step ST14). The print mechanism 56 is maintained at the waiting position so that the printing operation is not performed on the check 4. The check 4 is sent to the second check discharge section 12 by the switching plate 66, and then the check 4 is discharged through the second check discharge section 12 (Step ST14). After the discharge detector 65 detects the rear end of the check 4, the transport operation is stopped (Steps ST11 and ST12).

When the overlapping transport detector 62 detects an overlapping transport state of the check 4, an interruption process is performed to stop the transport. For example, an occurrence of an abnormal transport is indicated through a warning lamp or the like disposed in the manipulation unit 105, and then the operation waits until the check 4 is removed from the transport passage 5 and is returned to the initial state. Similarly, when the jam detector 63 detects that the check 4 is caught in the transport passage 5, the same interruption process is performed.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A check delivery device comprising:

a check insertion section into which a check to be delivered is inserted in a stacked state;

a check delivery port for delivering the check inserted into the check insertion section;

first and second guide surfaces that are opposed to each other to guide the check to the check delivery port;

a feed roller that is disposed at a side of the first guide surface and delivers the check inserted into the check insertion section, to the check delivery port;

a first pressing member that presses the check inserted into the check insertion section against the feed roller;

a second pressing member that presses into the first medium guide surface and presses the check inserted into the check insertion section against the first guide surface at a position deviating from the first pressing member; and a feed mechanism that delivers the check inserted into the check insertion section to the check delivery port.

2. The medium delivery device according to claim 1, wherein the second pressing member presses the sheet-shaped medium toward and in a direction of the first medium guide surface when the first pressing member moves toward the feed roller.

3. A medium delivery device comprising:

a medium insertion section into which a sheet-shaped medium to be delivered is inserted in a stacked state;

a medium delivery port for delivering the sheet-shaped medium inserted into the medium insertion section;

first and second medium guide surfaces that are opposed to each other to guide the sheet-shaped medium to the medium delivery port;

a feed roller that id disposed at a side of the first medium guide surface and delivers the sheet-shaped medium inserted into the medium insertion section, to the medium delivery port;

a first pressing member that presses the sheet-shaped medium inserted into the medium insertion section against the feed roller;

a second pressing member that presses into the first medium guide surface and presses the sheet-shaped medium inserted into the medium insertion section against the first medium guide surface at a position deviating from the feed roller; and a driving mechanism that drives the first pressing member in directions in which the first pressing member moves close to and away from the feed roller.

4. The medium delivery device according to claim 3, wherein the second pressing member is built into the first pressing member, protrudes from the first pressing member and moves in the direction in which the second pressing member moves towards the first medium guide surface.

5. The medium delivery device according to claim 3, wherein the second pressing member presses the sheet-shaped medium toward and in a direction of the first medium guide surface when the first pressing member moves toward the feed roller.

6. A medium delivery device comprising:

a medium insertion section into which a sheet-shaped medium to be delivered is inserted in a stacked state;

a medium delivery port for delivering the sheet-shaped medium inserted into the medium insertion section;

first and second medium guide surfaces that are opposed to each other to guide the sheet-shaped medium to the medium delivery port;

a feed roller that is disposed at a side of the first medium guide surface and delivers the sheet-shaped medium inserted into the medium insertion section, to the medium delivery port;

a first pressing member that presses the sheet-shaped medium inserted into the medium insertion section against the feed roller;

a second pressing member that presses into the first medium guide surface and presses the sheet-shaped medium inserted into the medium insertion section against the first medium guide surface at a position deviating from the feed roller;

a driving mechanism that drives the first pressing member in directions in which the first pressing member moves close to and away from the feed roller; and an interlocking mechanism that interlocks with an operation of the first pressing member to move the second pressing member in directions in which the second pressing member moves close to and away from the first medium guide surface.

7. The medium delivery device according to claim 6, wherein a press position where the sheet-shaped medium is pressed by the second pressing member is located between the feed roller and the medium delivery port.

8. The medium deliver device according to claim 7, wherein the medium insertion section has a medium receiving portion with a predetermined width for inserting the sheet-shaped medium and a medium guide portion having a width that becomes smaller as it becomes closer to the medium delivery port from a front end of the medium receiving portion, and the press position pressed by the second pressing member is located at a side of the front end of the medium receiving portion.

9. The medium delivery device according to claim 6, wherein the second pressing member is built into the first pressing member, protrudes from the first pressing member and moves in the direction in which the second pressing member moves towards the first medium guide surface by the interlocking mechanism.

10. The medium delivery device according to claim 6, wherein the driving mechanism has a rotation shaft that rotatably supports the first pressing member and a motor that rotates the first pressing member about the rotation shaft to a retreat position where the first pressing member retreats from the medium insertion section and to a protrusion position where the first pressing member protrudes into the medium insertion section.

11. The medium delivery device according to claim 10, wherein the interlocking mechanism includes:

a rotation shaft that couples the first pressing member with the second pressing member so that the second pressing member is rotatable in directions in which the second pressing member moves to and away from the first medium guide surface;

a spring member that urges the second pressing member in the direction in which the second pressing member moves to the first medium guide surface about the rotation shaft;

a member engagement section that is formed in the second pressing member; and a fixation engagement section that is formed at a fixed position at the side of the second medium guide surface, wherein while the first pressing member is at the retreat position, the member engagement section engages with the fixation engagement section to keep the second pressing member at a position retreating from the medium insertion section; and while the first pressing member is rotating from the retreat position to the protrusion position, the member engagement section deviates from the fixation engagement section and the second pressing member is rotated by the urging force of the spring member to protrude into the medium insertion section.

12. A medium processing apparatus comprising the medium delivery device according to claim 6.

13. The medium delivery device according to claim 6, wherein the second pressing member presses the sheet-shaped medium toward and in a direction of the first medium guide surface when the first pressing member moves toward the feed roller.

* * * * *

UNITED STATES PATENT AND TRADEMARK OFFICE

CERTIFICATE OF CORRECTION

PATENT NO. : 7,823,872 B2
APPLICATION NO. : 12/002578
DATED : November 2, 2010
INVENTOR(S) : Toshiyuki Sasaki It is certified that error appears in the above-identified patent and that said Letters Patent is hereby corrected as shown below:

In the Claims:

Claim 2, column 11, line 60, replace the word "medium" with the word -- check --.

Claim 3, column 12, line 6, replace the word "id" with the word -- is --.

Claim 8, column 12, line 64, replace the word "deliver" with the word -- delivery --.

Signed and Sealed this
Twenty-ninth Day of March, 2011

David J. Kappos

David J. Kappos
*Director of the United States Patent and Trademark Office*